US007992744B2

(12) United States Patent
Szymonski et al.

(10) Patent No.: US 7,992,744 B2
(45) Date of Patent: Aug. 9, 2011

(54) TISSUE SHEET DISPENSER AND PROCESS FOR MAKING SAME

(75) Inventors: Krzysztof A. Szymonski, Neenah, WI (US); Herb Velazquez, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 35 days.

(21) Appl. No.: 12/648,982

(22) Filed: Dec. 29, 2009

(65) Prior Publication Data

US 2010/0102077 A1 Apr. 29, 2010

Related U.S. Application Data

(63) Continuation of application No. 11/301,630, filed on Dec. 13, 2005, now Pat. No. 7,661,554.

(51) Int. Cl.

| | |
|---|---|
| ***B65H 3/00*** | (2006.01) |
| ***B65H 1/00*** | (2006.01) |
| ***A47K 10/24*** | (2006.01) |

(52) U.S. Cl. ..... 221/37; 221/33; 221/47; 221/50; 221/45; 221/48; 221/63; 221/39; 221/40; 221/151; 221/152; 221/302; 221/210; 206/219; 206/449; 206/494; 206/812; 206/409; 206/804

(58) Field of Classification Search ..... 221/50, 221/33, 47, 37, 45, 48, 63, 39, 40, 151, 152, 221/302, 210, 219, 449, 494, 812, 409, 804
See application file for complete search history.

(56) References Cited

U.S. PATENT DOCUMENTS

| | | | | |
|---|---|---|---|---|
| 2,032,150 | A * | 2/1936 | Richardson | 221/37 |
| 2,071,981 | A * | 2/1937 | Landsiedel | 221/37 |
| 2,269,039 | A | 1/1942 | Ross | |
| 2,269,525 | A * | 1/1942 | Fleischer | 221/33 |
| 2,885,112 | A * | 5/1959 | Willat | 221/33 |
| 3,265,242 | A * | 8/1966 | Davis | 221/63 |
| 3,276,622 | A * | 10/1966 | Krzyzanowski | 221/37 |
| 3,369,699 | A * | 2/1968 | Enloe et al. | 221/48 |

(Continued)

FOREIGN PATENT DOCUMENTS

| | | |
|---|---|---|
| WO | WO 9617794 | 6/1996 |

(Continued)

OTHER PUBLICATIONS

PCT Search Report, Oct. 31, 2006.

*Primary Examiner* — Gene O. Crawford
*Assistant Examiner* — Rakesh Kumar
(74) *Attorney, Agent, or Firm* — Dority & Manning, P.A.

(57) ABSTRACT

A dispenser, and associated method for producing such dispenser, for interfolded disposable sheets includes a dispensing container defining an interior volume sufficient for receipt of a clip of interfolded disposable sheets, the container including a first wall with a dispensing opening defined by a removable panel. At least a portion of an adhesive material is disposed at a location on the removable panel such that the adhesive is not exposed to the interior volume of the container in an adhesive state. A clip of interfolded disposable sheets is inserted into the interior volume of the container. After insertion of the clip, the adhesive material is exposed in an adhesive state to the interior volume of the container and contact is made between the adhesive and the uppermost sheet of the clip of interfolded sheets such that the removable panel is attached to the uppermost sheet.

6 Claims, 4 Drawing Sheets

U.S. PATENT DOCUMENTS

| | | | | | |
|---|---|---|---|---|---|
| 3,691,140 | A | | 9/1972 | Silver | |
| 3,843,017 | A | * | 10/1974 | Harrison | 221/63 |
| 3,857,731 | A | | 12/1974 | Merrill, Jr. et al. | |
| 3,868,052 | A | | 2/1975 | Rockefeller | |
| 3,935,135 | A | | 1/1976 | Dollhausen et al. | |
| 3,979,019 | A | | 9/1976 | Bliss | |
| 4,138,034 | A | | 2/1979 | McCarthy | |
| 4,166,152 | A | | 8/1979 | Baker et al. | |
| 4,197,964 | A | | 4/1980 | Pryor | |
| 4,231,491 | A | | 11/1980 | Pierson et al. | |
| 4,574,952 | A | * | 3/1986 | Masui | 206/494 |
| 4,681,240 | A | * | 7/1987 | Wyant | 221/48 |
| 4,739,902 | A | * | 4/1988 | Joslyn et al. | 221/37 |
| 4,786,696 | A | | 11/1988 | Bohnel | |
| 4,805,801 | A | * | 2/1989 | Knopf | 221/210 |
| 4,988,567 | A | | 1/1991 | Delgado | |
| 4,994,322 | A | | 2/1991 | Delgado et al. | |
| 5,045,569 | A | | 9/1991 | Delgado | |
| 5,046,640 | A | * | 9/1991 | Carroll | 221/213 |
| 5,197,630 | A | * | 3/1993 | Kirla | 221/37 |
| 5,518,144 | A | * | 5/1996 | Samuelson et al. | 221/33 |
| 5,542,568 | A | | 8/1996 | Julius | |
| 5,687,876 | A | * | 11/1997 | Lucas, Jr. | 221/259 |
| 5,810,200 | A | * | 9/1998 | Trokhan | 221/55 |
| 5,964,351 | A | | 10/1999 | Zander | |
| 5,992,682 | A | | 11/1999 | Loppnow et al. | |
| 6,145,698 | A | * | 11/2000 | Meyer | 221/37 |
| 6,268,032 | B1 | | 7/2001 | Mertens et al. | |
| 6,419,114 | B1 | | 7/2002 | Lenz et al. | |
| 6,474,046 | B1 | | 11/2002 | Ours et al. | |
| 6,715,633 | B2 | * | 4/2004 | Thoms | 221/37 |
| 6,880,704 | B2 | * | 4/2005 | Bredahl | 206/494 |
| 7,591,396 | B2 | * | 9/2009 | Tramontina et al. | 221/39 |
| 7,661,552 | B2 | * | 2/2010 | Baum et al. | 221/41 |
| 7,661,554 | B2 | * | 2/2010 | Szymonski et al. | 221/50 |
| 7,661,555 | B1 | * | 2/2010 | Evans et al. | 221/259 |
| 2003/0062376 | A1 | | 4/2003 | Sears et al. | |
| 2003/0168467 | A1 | | 9/2003 | Thoms | |
| 2006/0151518 | A1 | | 7/2006 | Sarbo et al. | |

FOREIGN PATENT DOCUMENTS

| | | |
|---|---|---|
| WO | WO 0061458 | 10/2000 |
| WO | WO 2005/113381 | 12/2005 |

* cited by examiner

TISSUE SHEET DISPENSER AND PROCESS FOR MAKING SAME

RELATED APPLICATION

The present application is a Continuation application of U.S. application Ser. No. 11/301,630 having a filing date of Dec. 13, 2005.

BACKGROUND OF THE INVENTION

Disposable sheet style dispensers are well-known in the art for dispensing individual folded sheet products such as facial tissues, hand sheets, wet wipes, or the like. In general, disposable sheet dispensers typically include a container and a stack or clip of pre-folded, interfolded sheets disposed within the container. The sheets may be C-folded, V-folded, Z-folded, tab-bonded or flat so that once the top sheet in the clip is withdrawn, the underlying sheet is individually presented for subsequent use.

One of the common problems among disposable sheet dispensers involves the issue of "double pull". This occurs when more than one sheet comes out of the container when the leading sheet is withdrawn. Additionally, the problem of "streaming" can occur in disposable sheet dispensers. Streaming occurs when the user pulls the first sheet out, and subsequent sheets are also withdrawn, with the separation of the following ones never occurring.

To overcome some of these problems, disposable sheet dispensers have been designed with the dispensing slot covered by a plastic film defining a slit. The use of slits has worked well in eliminating some of the above problems, and narrow slits are also well suited for presenting tissue sheets for subsequent removal. In some applications, however, it is sometimes difficult to remove the initial sheet from the stack when a slit is present. For instance, the slit can interfere with the ability of a user to grab the leading edge.

In order to overcome some of these problems, in U.S. Pat. No. 4,574,952 to Masui, which is incorporated herein by reference for all purposes, a box containing facial tissues is disclosed in which a tape or strings are attached to the undersurface of a removable panel of the box and to the upper most of the facial tissues. In this manner, when the box is opened, and the removable panel is removed along a perforated line, the upper most facial tissue is automatically removed from the container along with the removable panel.

In U.S. Pat. No. 6,715,633 to Thoms, which is also incorporated herein by reference for all purposes, a dispenser for dispensing a stack of disposable sheets is disclosed having a removable panel that is releasably attached to the first sheet in the stack. When the removable panel is pulled off the container, the first sheet in the stack is partially withdrawn from the container. After being partially withdrawn, however, the sheet releases from the removable panel.

Although the above two patents have provided advancements in the art, further improvements are still needed. For example, with the methods disclosed in the above cited patents, the adhesive is exposed to the interior volume of the dispenser during manufacture of the structure and subsequent insertion of the clip of interfolded sheets. This situation is disadvantageous in that the adhesive may interfere with production of the dispenser container and loading of the clip of sheets into the dispenser. Also, the potential exists for the adhesive to become soiled by any manner of particulate matter inherently present in any facility that processes tissue products, thus rendering the adhesive ineffective.

SUMMARY OF THE INVENTION

In general, the present disclosure is directed to a dispenser for dispensing interfolded disposable sheets. A stack ("clip") of interfolded disposable sheets is housed within a container and the sheets are arranged to be withdrawn from the container one after another. The sheets can be various paper products, including facial tissues, paper towels, industrial wipers, laboratory wipers, wet wipes, and the like. The dispensing container includes a removable panel that, once removed, uncovers an opening for withdrawing the sheets. In certain embodiments, the removable panel is a portion of a top or side wall of the container that has been perforated for easy removal by a consumer. In other embodiments, the removable panel may be a separate piece of material, such as a film, paperboard, or the like, that is removably attached to the container wall to overlie the dispensing opening and is removed by the consumer prior to use of the dispenser.

The removable panel is attached to a first sheet in the clip of interfolded sheets. In particular, the removable panel is adhered to the first sheet such that when the removable panel is removed from the dispensing container, the first sheet is pulled through the dispensing opening in the container. The sheet may be released from the removable panel so as to remain at least partially within the container, or may be completely withdrawn from the dispensing container when the panel is removed.

In particular embodiments, the removable panel is attached to the first sheet in the clip of interfolded sheets by an adhesive material that is exposed to the interior volume of the container in an adhesive or "activated" state only after the clip of interfolded sheets has been inserted into the container. Prior to insertion of the clip, the adhesive is inactivated (i.e., non-adhesive) or, if in an adhesive sate, kept isolated from the interior volume of the container. In this manner, the adhesive material does not interfere with the manufacturing process, particularly insertion of the clip of interfolded sheets into the container.

Once the clip of interfolded sheets is loaded into the dispensing container, the adhesive is then exposed to the interior volume of the container in an adhesive conditions and may be contacted with the first sheet in the clip by various means. For example, the container may be inverted to cause the first sheet in the clip to rest on the removable panel. Alternately, the removable panel may be pressed into contact with the first sheet in the clip by applying external pressure to the outside surface of the removable panel.

In a particular embodiment, the adhesive material is applied in an unactivated state between an underside of the removable panel and the clip of interfolded sheets, and is subsequently activated to an adhesive state after insertion of the clip into the container. For example, the adhesive material may be applied entirely to the underside of the removable panel in its unactivated state and subsequently activated by exposure of the dispenser to an external stimulus after the clip of sheets has been loaded into the dispenser. Various types of activatable adhesives may be used in such an embodiment, including various commercially available RF or UV activated adhesives, wherein the container is exposed to a source of RF or UV energy after insertion of the clip in order to activate the adhesive.

In an alternate embodiment, the adhesive material is a two-part adhesive that is not activated until the two component parts are brought into contact. For example, the two-part adhesive may be an epoxy adhesive that is not activated until a resin component is brought into contact with a hardener component. A first part of the adhesive may be disposed on the underside the removable panel and the second part of the adhesive may be disposed on the uppermost sheet of the clip of interfolded sheets. However, the individual parts are not in an adhesive state and thus do not interfere with insertion of the clip or other manufacturing steps. After the clip has been inserted, the adhesive material is activated or exposed to the interior volume in an adhesive state by contacting the uppermost sheet against the underside of the removable panel such that the adhesive components are brought into contact for a sufficient time to blend and form the adhesive material.

In alternate embodiments, the adhesive material may be physically isolated from the interior volume of the container until after insertion of the clip, wherein the adhesive is moved from it isolated location into a position within the container to contact the top sheet in the clip. In a particular embodiment, the removable panel includes a hinged flap and the adhesive material is disposed on an upper (external) side the flap. This flap may take on various forms. For example, the flap may be a perforated portion of the removable panel, or a separate material disposed over an opening in the removable panel. The adhesive material is exposed to the interior volume of the container by repositioning the flap so as to bring the adhesive into a facing position relative to the uppermost sheet in the clip of interfolded sheets. The flap may be repositioned simply by being pressed down into the interior volume so as to fold at least partially under the removable panel and expose the adhesive material to the uppermost sheet. The flap may have sufficient resiliency after being folded under the removable panel to move into direct contact with the first sheet in the clip simply upon release of the flap. Alternately, the container may be inverted to cause the first sheet to contact the adhesive on the down-turned face of the flap. If desired, the adhesive may be protected by a release liner that is removed by the user prior to activating the dispenser.

The present invention encompasses any manner of dispenser made in accordance with the method principles described herein.

The dispensing container can be made from various materials and is generally not critical to the present invention. For instance, the dispensing container can be made from paperboard or from a flexible polymer film. The dispensing container can be in the shape of a rectangular box, a square box, or in the form of any other suitable shape.

Other features and aspects of the present invention are discussed in greater detail below.

BRIEF DESCRIPTION OF THE DRAWINGS

An embodiment of the present invention is described by way of example with reference to the accompanying drawings, in which.

Figure 1:
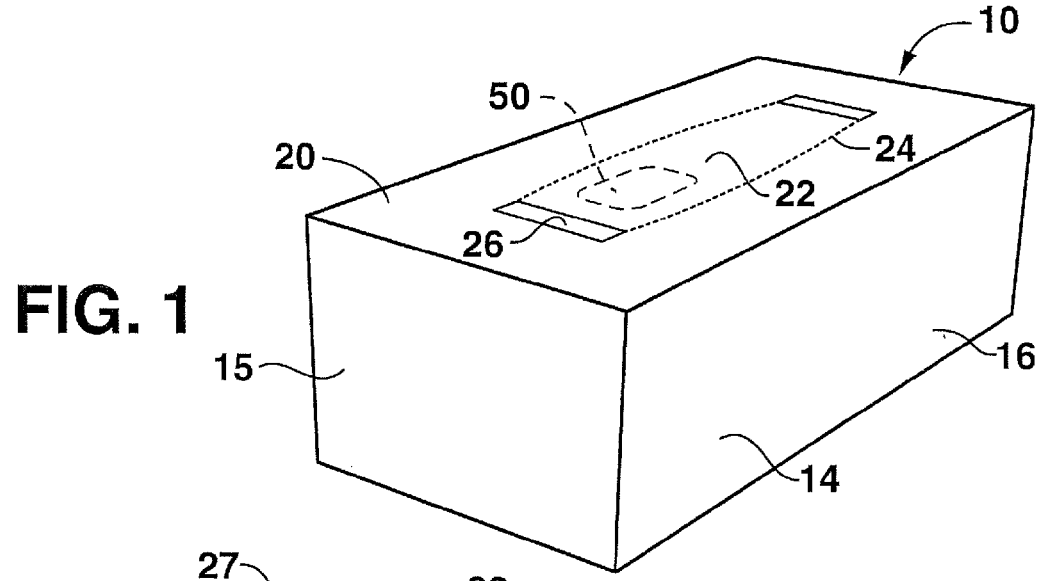
FIG. 1 is a perspective view of one embodiment of a dispenser made in accordance with the present disclosure.

Repeat use of reference characters in this present specification and drawings is intended to represent same or analogous features or elements.

DETAILED DESCRIPTION

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention includes these and other modifications and variations.

In general, the present disclosure is directed to a dispenser for dispensing interfolded disposable sheets from a clip. The disposable sheets can be, for instance, facial tissues, paper towels, industrial wipers, laboratory wipers, wet wipes, and the like. The dispensing container includes a removable panel that, once removed, uncovers an opening for withdrawing the sheets. The removable panel is attached to the first sheet in the clip with an adhesive material that is not exposed to the interior volume of the container in an adhesive state until the clip of interfolded sheets has been loaded into the container. Once the clip has been placed into the container, the adhesive material may be positioned, activated, or otherwise acted upon so as to be exposed within the interior volume in an adhesive state. The uppermost ("top" or "first") sheet in the clip is then brought into contact with the adhesive material to attach the sheet to the removable panel. Various embodiments of this methodology are discussed in detail below by reference to the figures.

Depending upon the particular application and the desired result, the adhesive material may securely affix the removable panel to the first sheet in the clip or may be releasably attached to the first sheet. For example, in one embodiment, the removable panel is attached to the first sheet in a manner such that when the panel is removed from the dispensing container, the first sheet is partially withdrawn. Once the sheet is partially withdrawn, the first sheet then detaches from the removable panel. Thus, once the panel is removed from the container, the first sheet in the clip is available for easy and immediate removal. Reference is made to U.S. Pat. No. 6,715,633 discussed above (and incorporated herein by reference) for a more detailed description of this feature. In an alternative embodiment, the removable panel may be more securely affixed to the first sheet in the clip of disposable sheets such that the first sheet is completely withdrawn from the dispensing container when the removable panel is removed. It should be appreciated that any degree of attachment between the adhesive and first sheet in the clip that results in at least partial withdrawal of the first sheet upon removal of the panel is within the scope of the invention.

Referring to the figures in general, embodiments of a dispensing container generally 10 are illustrated for housing a clip 12 of any manner of interfolded sheets, such as facial tissue. It should be understood that the invention is not limited to any particular type of interfolded disposable sheets. The clip of interfolded disposable sheets 12 may be C-folded, V-folded, Z-folded, tab-bonded or configured with respect to one another by any means commonly known in the art.

The dispensing container 10 may take on any desired geometric shape and size. In the illustrated embodiments, the container 10 includes a pair of sides or walls 16, end walls 15, a bottom wall 14, and a top wall 20. The walls define an interior volume sized for receipt of the clip 12 of interfolded sheets, which generally rest upon the bottom wall 14.

The top wall 20 of the container 10 includes a removable panel 22 that, once removed, exposes a dispensing opening 42 in the top wall 20. The removable panel 22 may include an end extension 26 at one or both ends thereof configured to allow a consumer to grasp either of the end extensions 26 in order to pull the panel 22 away from the top wall 20. The panel 22 may be "removable" relative to the top wall 20 by various means. For example, in the embodiment of FIGS. 1 through 3, the panel 22 is defined by perforations 24 in the material of the top wall 20. In an alternate embodiment illustrated, for example, in FIGS. 4 and 6A, the panel 22 is a separate material member attached to the top wall 20 over the dispensing opening 42 by, for example, any suitable releasable adhesive. This separate material member may be the same material as used for the container walls, or a different material, such as a film.

Figure 2:
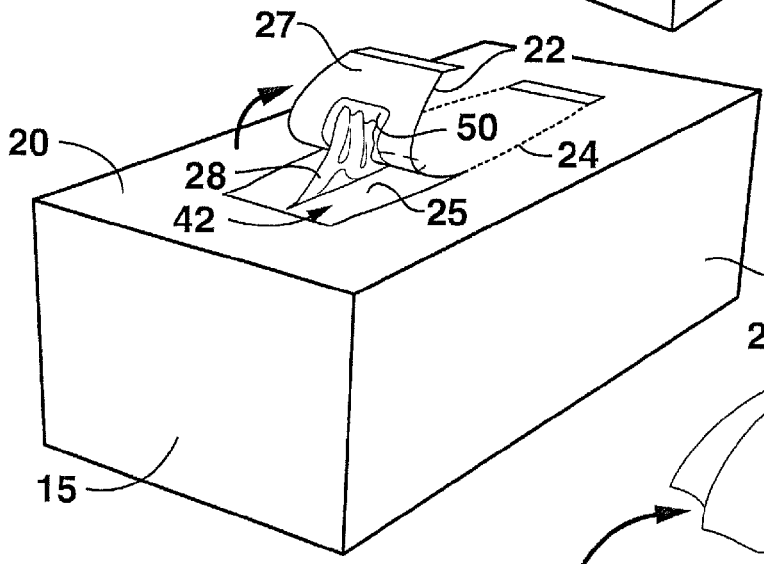
FIG. 2 is a perspective view of the dispenser illustrated in FIG. 1 showing the dispenser partially opened.
Figure 3:
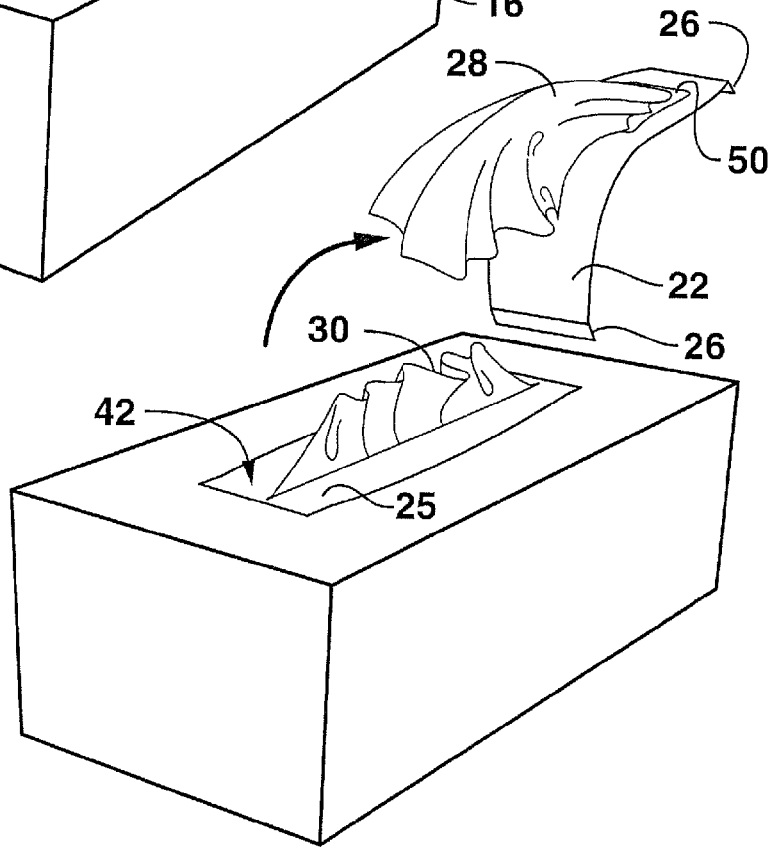
FIG. 3 is a perspective view of the dispenser illustrated in FIG. 1 showing the removable panel of the dispenser removed exposing a sheet of material available to be withdrawn.

It may be desired to include a film layer 25 over the dispensing opening 42 in addition to the removable panel 22, as illustrated in FIGS. 1 through 3. This film 25 may be any suitable polymer film that includes an opening, such as a slit, to facilitate dispensing the sheets one at a time and to accommodate the various adhesive combinations and embodiments described herein.

In general, the dispensing container 10 can be made from various materials. For instance, the container can be made from paperboard or cardboard. Alternatively, the container can be made from plastic films, such as thermoplastic films. Materials used to form the walls of the container can be rigid or flexible.

Figure 4:
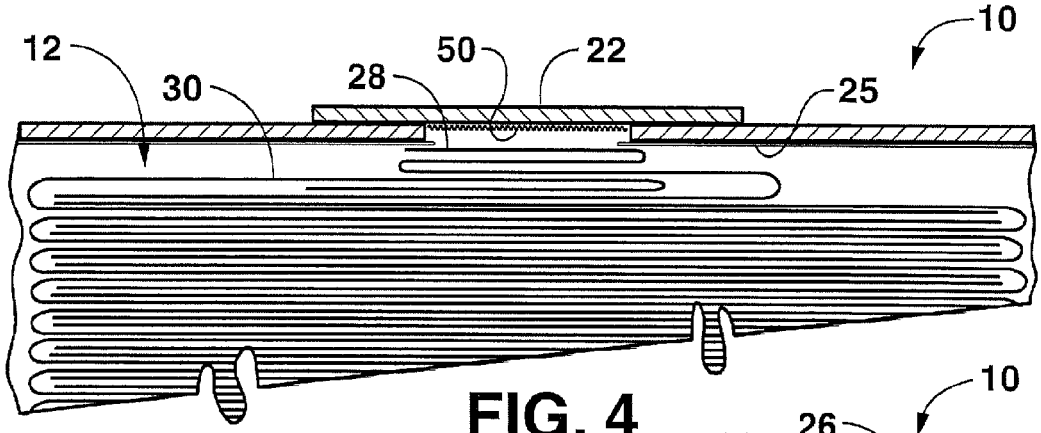
FIG. 4 is a cross-sectional view of a particular embodiment of a dispenser illustrating an unactivated adhesive disposed on the underside of a removable panel member.
Figure 6A:
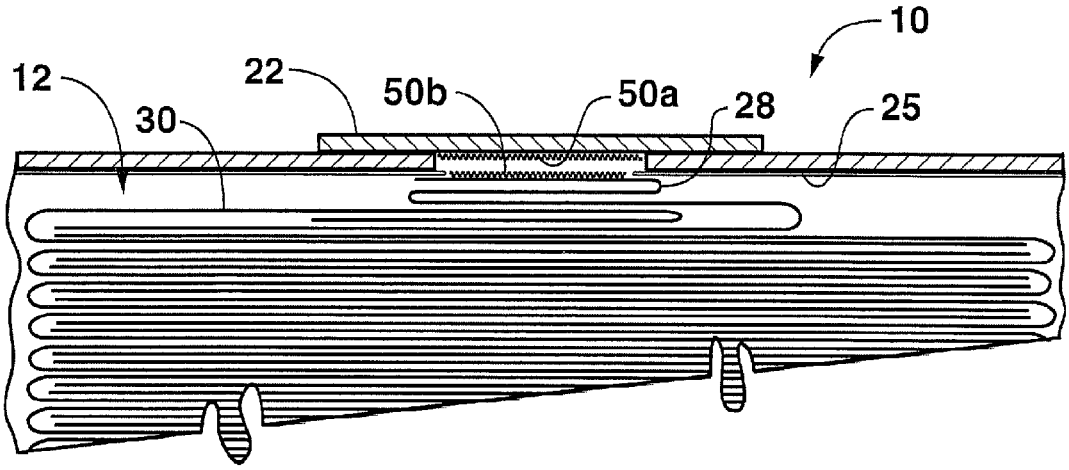
FIG. 6A is a cross-sectional view of a particular embodiment of a dispenser illustrating a two-part adhesive between a removable panel member and the uppermost sheet in the clip of interfolded sheets.

As illustrated in the figures, below the top wall 20 is the clip 12 of interfolded sheets with an uppermost or top sheet 28. The sheets may be interfolded in various fold patterns known to those skilled in the art, such as C-folds, V-folds, and so forth. In FIGS. 4 and 6A, the first sheet 28 is folded multiple times at the top to facilitate removal of the sheet. In addition to being folded upon itself, the end of the first sheet 28 is also connected to the removable panel 22 by an adhesive material 50. In this manner, when the removable panel 22 is removed from the upper wall 20 of the container, the first sheet 28 is pulled at least partially through the opening 42. Once the end of the first sheet 28 is removed through the opening 42, however, resistance increases due to the first sheet 28 being interfolded with the next sheet in the stack 12 and/or due to the resistance of the sheet being pulled through the opening 42. Depending on the strength of the adhesive material 50, this increased resistance may be sufficient to cause the end of the first sheet 28 to release from the removable panel 22, leaving the first sheet 28 partially exposed. In an alternate embodiment, for example as illustrated in FIG. 3, the first sheet 28 remains attached to the panel 22 and is completely pulled out of the container 10 through the opening 42 with removal of the panel 22. The size and construction of the opening 42 can also be used to control the amount of force needed to either partially remove or completely remove the first sheet in the stack of disposable sheets. For example, the opening 42 can be designed to increase the resistance placed on the first sheet 28 as it is withdrawn from the container. Increasing the resistance facilitates release between the sheet and the removable panel. Decreasing the resistance, on the other hand, may allow for the entire sheet to be withdrawn.

The adhesive material 50 used in the various embodiments to attach the top sheet 28 to the removable panel 22 is not activated or exposed to the interior volume of the container 10 in an adhesive condition until the clip 12 of interfolded sheets has been inserted into the container 10. In this manner, the adhesive material 50 does not interfere with the manufacturing process, particularly insertion of the clip 12 into the container.

In the embodiment illustrated, for example, in FIGS. 1 through 5B, the adhesive material 50 is applied at a select location on the underside 27 of the removable panel 22 at some point during production of the dispensing container 10 and prior to loading of the clip 12 into the container 10. However, the adhesive material 50 is of a type of adhesives that may be applied in an inactivated state, and is not activated or transformed into an adhesive condition until subjected to an external stimulus. Various types of activatable adhesives may be used in this regard, including various commercially available RF or UV activated adhesives. FIG. 5A illustrates the clip 12 of interfolded sheets being inserted into the container 10 having the adhesive material 50 applied to the underside of the removable panel 22 in an inactivated state prior to formation of the container into its box-like configuration. After the clip 12 is inserted into the container 10, and the end walls 15 are sealed or joined by any conventional manner, the entire container 10 may be subjected to an external stimulus, generally 52 in FIG. 5B, in order to activate the adhesive material 50. For example, referring to FIG. 5B, the container 10 is illustrated as inverted so that the top wall 20 and removable panel 22 may be readily passed over an RF or UV source 54. The source 54 may be any conventional UV or RF generating source, and is illustrated diagrammatically in FIG. 5B for conceptual purposes only. The container 10 is inverted so that once the adhesive material 50 is activated by the external stimulus, the top sheet 28 within the stack 12 will immediately adhere to the material. Of course, in an alternate embodiment, the step of inverting the container 10 to contact the top sheet 28 to the adhesive material 50 may be performed after the adhesive material 50 has been activated by the external source 54 (from above or below the container 10).

Figure 5A:
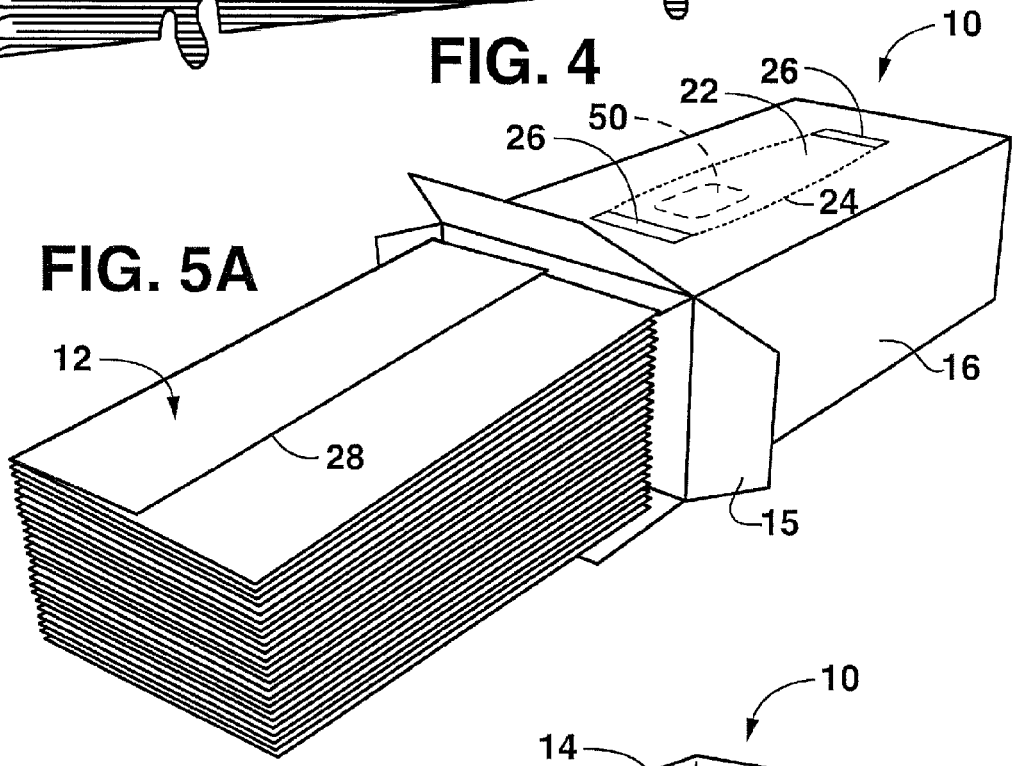
FIG. 5A is a perspective view illustrating a clip of interfolded sheets being loaded into a dispenser having an unactivated adhesive on the underside of a removable panel member.
Figure 5B:
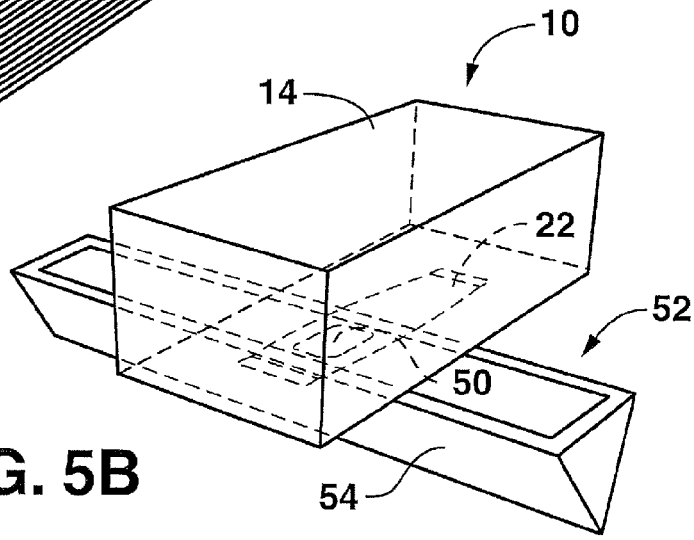
FIG. 5B is a perspective view illustrating the loaded dispenser being passed over an external stimulus source to activate the adhesive on the underside of a removable panel member.

FIG. 4 is a cross-sectional view of the embodiment of FIG. 5B after the stack 12 of sheets has been loaded into the container 10, but prior to activation of the adhesive material 50 and inversion or other manipulation of the container 10 in order to cause the top sheet 28 to come into contact with the adhesive material 50. An alternate method of contacting the top sheet 28 with the adhesive material 50 may involve applying an external pressure to the upper surface of the removable panel 22 in order to push the panel and activated adhesive material 50 into contact with the top sheet 28.

It should be appreciated that various types of single component adhesives that are cured by an external stimulus, such as a light, UV, RF, or microwave source, are well known in the adhesive art and may be used with embodiments of the present invention. Vendors of these types of adhesives include Jenton UV (division of Jenton International), Cyberbond LLC, Electro-Lite Corporation, and Parson Adhesives, Inc.

The embodiment wherein the adhesive material 50 is activated at a subsequent time after insertion of the clip 12 is readily adaptable to conventional manufacturing lines wherein the dispensing container 10 is formed from a one-piece blank that is subsequently assembled into a flat sleeve configuration. The inactivated adhesive material 50 may be applied to a location on the blank panel corresponding to the underside of the top wall 20 and removable panel 22 prior to forming the blank into the flat sleeve configuration. For convenience and manufacturing efficiency, it is often the case that the dispensing containers 10 are stored or transported in the flat sleeve configuration prior to being loaded with a clip of disposable interfolded sheets at a subsequent production location. In this flat sleeve configuration, the underside of the top wall lies in contact with other walls of the container 10. However, because the adhesive material 50 is inactivated, the adhesive will not cause the walls to adhere together, and thus will not interfere with subsequent formation of the flat sleeves into a box-like container 10.

It should be appreciated that, depending on the type of activatable adhesive, provision may be necessary in the container for supply of the external stimulus. For example, in the case of a UV activated adhesive, it may be necessary to provide a transparent panel or film in the container at a location such that UV energy may be supplied to the adhesive subsequent to insertion of the clip of sheets. The top wall 20, or a portion of the wall, may be made of a transparent material.

Figure 6B:
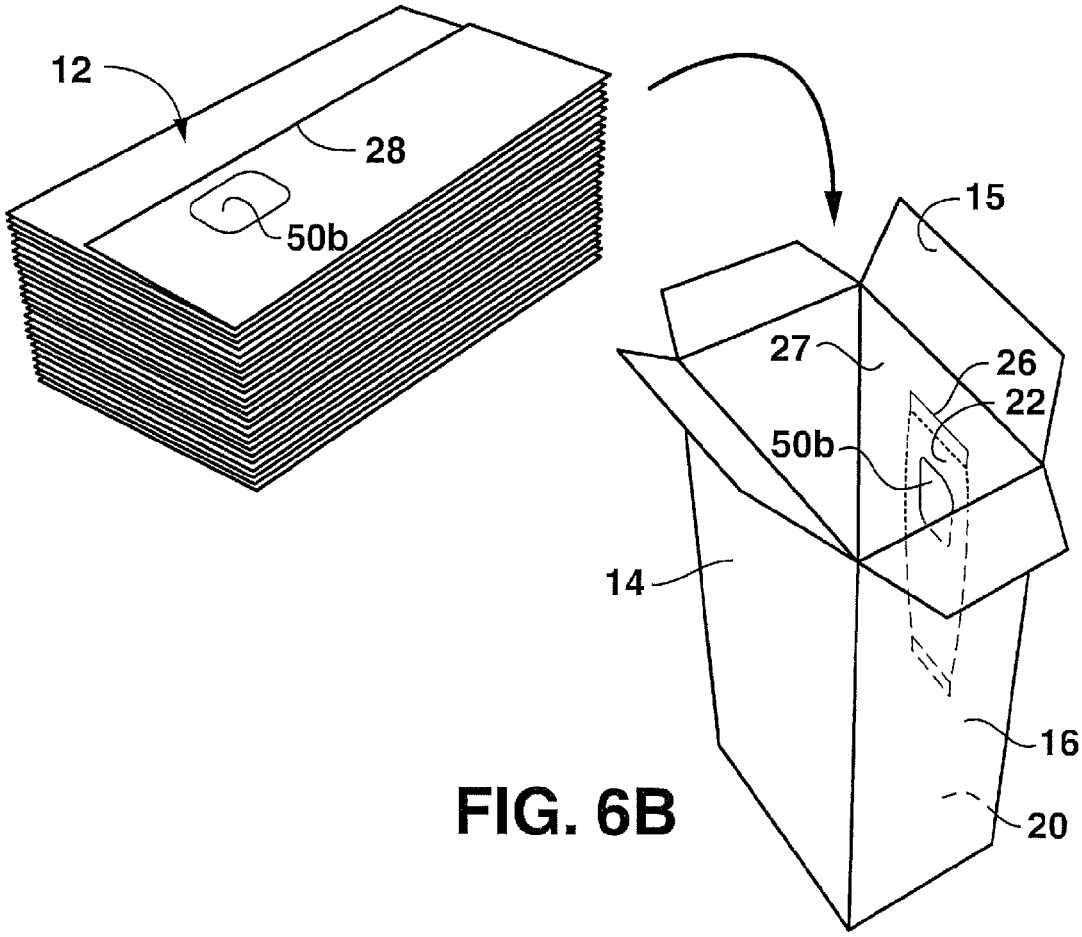
FIG. 6B is a perspective view illustrating a clip of interfolded sheets and a dispenser, particularly illustrating use of a two-part adhesive.

FIGS. 6A and 6B illustrate an alternative embodiment wherein an adhesive material is maintained in an inactivated or non-adhesive condition until a stack 12 of interfolded disposable sheets have been loaded into the container 10. In this embodiment, the adhesive material 50 is a two-part adhesive that is not activated until the two component parts are brought into contact. For example, the two part adhesive 50 may be an epoxy, acrylic, or urethane adhesive that is not activated until a resin component is brought into contact with a hardener component. Referring to the figures, a first component part 50*a* of the adhesive may be disposed on the underside of the removable panel 22, and the second component part 50*b* of the adhesive may be disposed on the uppermost sheet 28 of the clip of interfolded sheets 12, as particularly illustrated in FIG. 6B. The consistency of the component adhesive parts may be controlled so that the components are generally non-flowable, and are preferably in a near solid condition. In this manner, the component parts 50*a*, 50*b*, remain at their desired location during manufacture of the container 10 and loading of the clip 12 into the container. The individual components 50*a* and 50*b* are not individually adhesive and thus do not interfere with insertion of the clip 12 or other manufacturing steps.

FIG. 6A illustrates the embodiment after the clip 12 has been loaded into the container 10. It can be seen that the component adhesive parts 50*a* and 50*b* are in an opposite facing orientation, but are not yet in contact with each other. After the clip 12 has been loaded and the ends 15 of the container 10 have been sealed, the components 50*a* and 50*b* can be readily brought into contact with each other in order to activate the adhesive. This may be done by inverting the container 10, or applying pressure to the external side of the removable panel 22, as discussed above.

Any number of multiple component adhesives are commercially available and may be used in various embodiments of the invention. Examples of such adhesives include two part acrylics, epoxies, and urethanes. 3M Corporation offers various commercially available versions of these adhesives.

Figure 7A:
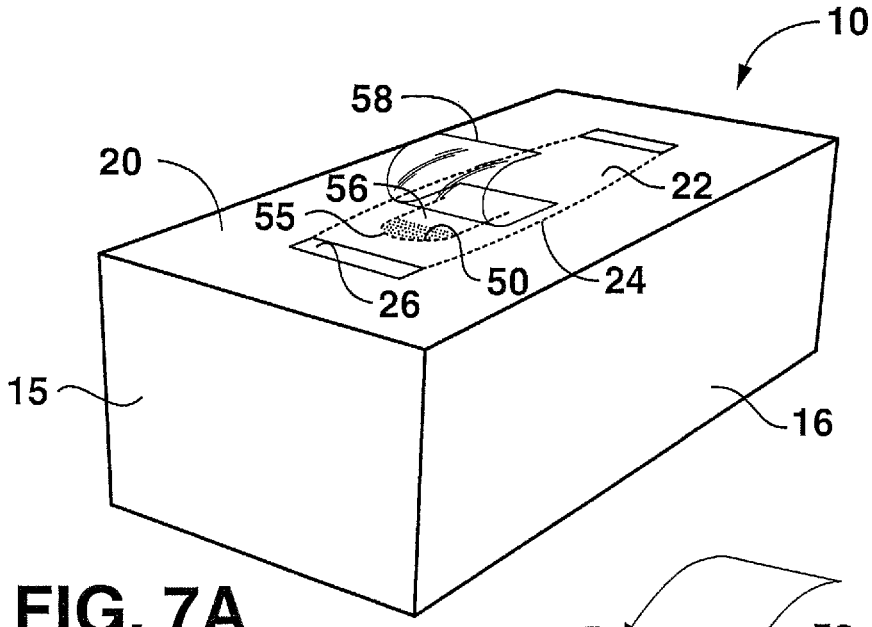
FIGS. 7A through 7C are perspective views of a particular embodiment of a dispenser wherein an adhesive is disposed on a hinged flap member of the removable panel.
Figure 7B:
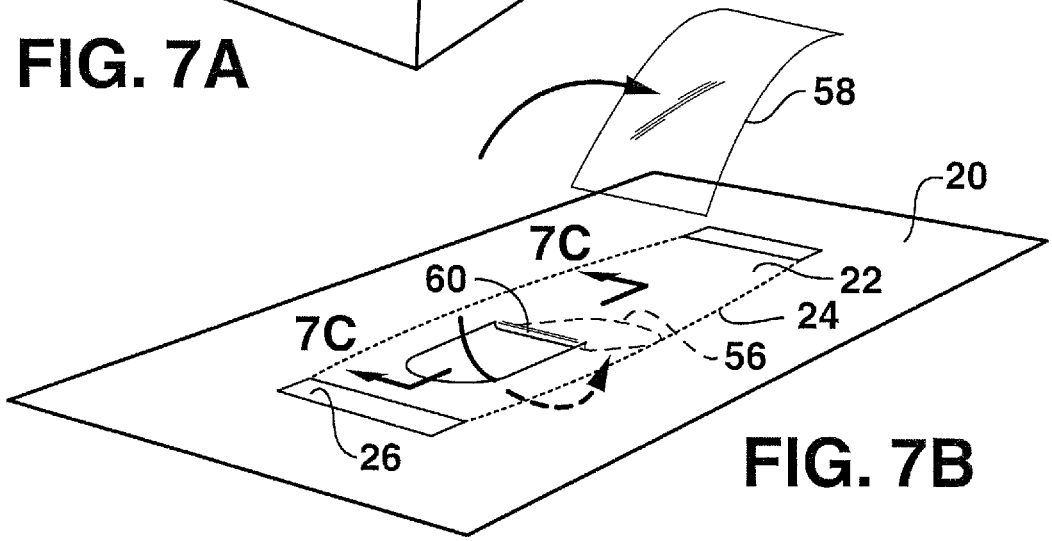
Figure 7C:
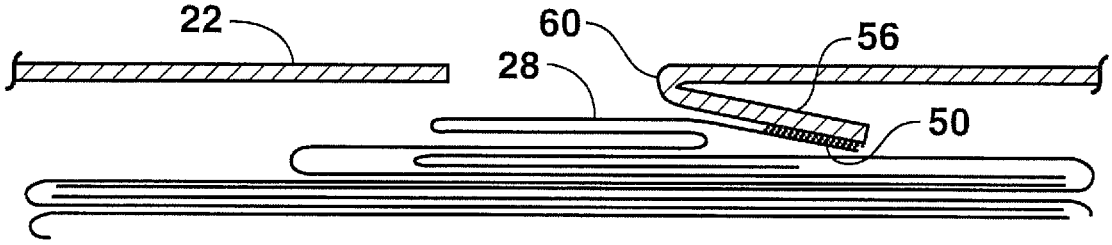

FIGS. 7A through 7C illustrate still another alternative embodiment wherein the adhesive material 50 is isolated from the interior volume of the container 10 until after insertion of the clip 12 of interfolded disposable sheets. This embodiment illustrates a mechanical means for isolating the adhesive material 50. In particular, the removable panel 22 includes a hinged flap 56 defined in the panel 22 by, for example, perforations 55. An adhesive material 50 is disposed on the upper surface of the hinged flap 56 in any desired pattern. Preferably, at least a portion of the hinged flap 56 is not covered by the adhesive material 50 so that the hinged flap 56 may be depressed into the interior volume of the container 10 by a user's finger or thumb without contacting the adhesive material 50. Also, a release liner 58 may be disposed over the hinged flap 56 to protect adhesive material 50 until such time that the hinged flap 56 is repositioned to expose the adhesive material 50 to the interior volume of the container 10, as described below.

FIG. 7B illustrates the process of repositioning the hinged flap 56. In particular, the release liner 58 is pulled away from the upper surface of the hinged flap 56 to expose the adhesive material 50. Then, the hinged flap 56 is depressed downwardly so that it separates from the panel 22 along the perforations 55. This action causes the hinged flap 56 to pivot along hinge line 60 into the interior volume of the container 10 and to fold at least partially under the panel 22. The flap 56 is pushed to a position such that the adhesive material 50 is brought into a facing relationship with respect to the top sheet 28 of the clip 12 of interfolded sheets, as particularly illustrated in FIG. 7C. The flap 56 may have sufficient resiliency after being folded under the removable panel 22 so as to move back into direct contact with the first sheet 28. In this manner, the adhesive material 50 is pressed into contact with the top sheet 28 causing the sheet to adhere to the flap 56. Alternately, the container may be inverted to cause the first sheet 28 to contact the adhesive 50 on the face of the flap 56. At this point, the top sheet 28 will sufficiently adhere to the removable panel 22 such that the top sheet 28 will be pulled out of the dispensing opening 42 upon removal of the panel 22 from the top wall 20, as discussed above.

The adhesive material 50 used in the embodiments of FIGS. 7A through 7C may comprise any suitable adhesive, including a hot melt adhesive or a pressure sensitive adhesive. Suitable hot melt adhesives are commercially available from Bostik Findley. Suitable pressure sensitive adhesives are disclosed, for example, in U.S. Pat. Nos. 5,045,569; 4,988,567; 4,994,322; 4,786,696; 4,166,152; 3,857,731; and 3,691,140, all which are incorporated herein by reference in their entirety for all purposes. The amount of adhesive that is applied to the hinged flap 56 may vary depending upon various factors, including the type of adhesive material used, and the extent to which bonding is desired between the removable panel 22 and the upper disposable sheet 28.

It should be appreciated that any of the embodiments illustrated and described herein may include a polymeric film 25 between the removable panel 22 and top sheet 28 in the clip of interfolded sheets, as particularly illustrated in FIGS. 2, 3, and 4. The film 25 may include any manner of slit, hole, opening, or other structure to accommodate the particular type of adhesive material 50 used to attach the top sheet 28 to the removable panel 22, or hinged flap 56.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims.

What is claimed is:

1. A method for producing a dispenser for interfolded disposable sheets comprising:

providing a dispensing container defining an interior volume sufficient for receipt of a clip of interfolded disposable sheets, the container including a first wall with a dispensing opening defined by a removable panel in the first wall;

providing a hinged flap within the confines of the removable panel, the hinged flap having a first configuration that is coplanar with the removable panel such that an upper surface of the hinged flap is coplanar with an upper surface of the removable panel, and a second configuration wherein the hinged flap pivots down from the removable panel into the interior volume of the container;

locating an adhesive material at a location on the upper surface of the hinged flap in the first configuration of the hinged flap such that the adhesive is not exposed to the interior volume of the container in an adhesive state;

inserting a clip of interfolded disposable sheets into the interior volume of the container;

after the clip of interfolded disposable sheets is housed within the container, pivoting the hinged flap relative to the removable panel into the interior volume of the container so as to bring the upper surface of the hinged flap and the adhesive into a facing position relative to the uppermost sheet of the clip of interfolded sheets;

contacting the uppermost sheet of the clip of interfolded sheets to the adhesive material on the hinged flap; and removing the removable panel with attached hinged flap from the first wall such that the uppermost sheet attached to the hinged flap is pulled from the container.

2. The method as in claim 1, wherein the hinged flap is pushed externally into the interior volume of the container so as to fold along a hinge line at least partially under the removable panel to expose the adhesive material to the uppermost sheet.

3. A dispenser for dispensing a clip of interfolded disposable sheets, comprising:

a container defining an interior volume sufficient for receipt of a clip of interfolded disposable sheets, said container including a first wall with a dispensing opening defined by a removable panel in said first wall;

a hinged flap defined within confines of said removable panel, said hinged flap having a first configuration wherein an upper surface of said hinged flap is coplanar with an upper surface of said removable panel, and a second configuration wherein said hinged flap pivots down from said removable panel into the interior volume of said container;

an adhesive material disposed on said upper surface of said hinged flap in said first configuration of said hinged flap such that said adhesive material is not exposed to said interior volume of said container in said first configuration of said hinged flap; and wherein in said second configuration of said hinged flap, said upper surface of said hinged flap with said adhesive material thereon is brought into a facing position relative to a clip of interfolded sheets within said container such that the uppermost sheet of the clip of interfolded sheets becomes attached to said exposed adhesive material on said folded hinged flap and is pulled at least partially out of said container through said dispensing opening upon subsequent removal of said removable panel from said container.

4. The dispenser as in claim 3, wherein said hinged flap comprises a perforated portion of said removable panel that is pushable into said interior volume of said container so as to fold at least partially under said removable panel.

5. The dispenser as in claim 4, wherein said removable panel is defined by a perforated portion of said first wall.

6. The dispenser as in claim 4, wherein said removable panel comprises a film material extending over said dispensing opening.

* * * * *